United States Patent [19]

Turchi et al.

[11] 4,396,867

[45] Aug. 2, 1983

[54] INDUCTIVE INTENSE BEAM SOURCE

[75] Inventors: Peter J. Turchi, Alexandria, Va.; Ihor M. Vitkovitsky, Silver Spring, Md.

[73] Assignee: The United States of America as represented by the Secretary of the Navy, Washington, D.C.

[21] Appl. No.: 285,661

[22] Filed: Jul. 21, 1981

[51] Int. Cl.[3] ..... H05H 1/24

[52] U.S. Cl. ..... 315/111.41; 328/227; 328/233; 315/111.51; 315/111.61

[58] Field of Search ..... 328/233, 256; 315/111.61, 111.21, 111.41; 313/260

[56] References Cited

U.S. PATENT DOCUMENTS

| | | | |
|---|---|---|---|
| 3,183,403 | 5/1965 | Hurwitz et al. | 315/111.61 |
| 3,638,127 | 1/1972 | Kern | 328/227 |
| 3,761,828 | 9/1973 | Pollard et al. | 328/233 X |
| 3,863,103 | 1/1975 | Eckbreth et al. | 315/111.21 |
| 4,156,832 | 5/1979 | Kistemaker et al. | 315/111.41 |
| 4,293,794 | 10/1981 | Kapetanakos | 315/111.41 |
| 4,339,691 | 7/1982 | Morimiya et al. | 315/111.21 |
| 4,361,812 | 11/1982 | Farrell et al. | 328/233 |

*Primary Examiner*—John S. Heyman

*Attorney, Agent, or Firm*—Robert F. Beers; William T. Ellis

[57] ABSTRACT

An inductive intense beam source utilizing a plurality of fuses (or a cylindrical foil) surrounding a plasma column. The fuses (or foil) carry a current and thus establish an inductive energy storage volume therearound which is segregated from the plasma column. When the fuses or foil are vaporized, the energy stored therearound is converted to kinetic energy in the form of an accelerated particle beam.

17 Claims, 5 Drawing Figures

INITIAL CONFIGURATION

ACCELERATION PHASE $$V_{ACC} = L \frac{dI_0}{dt}$$

INITIAL CONDITIONS: FIG. 2a
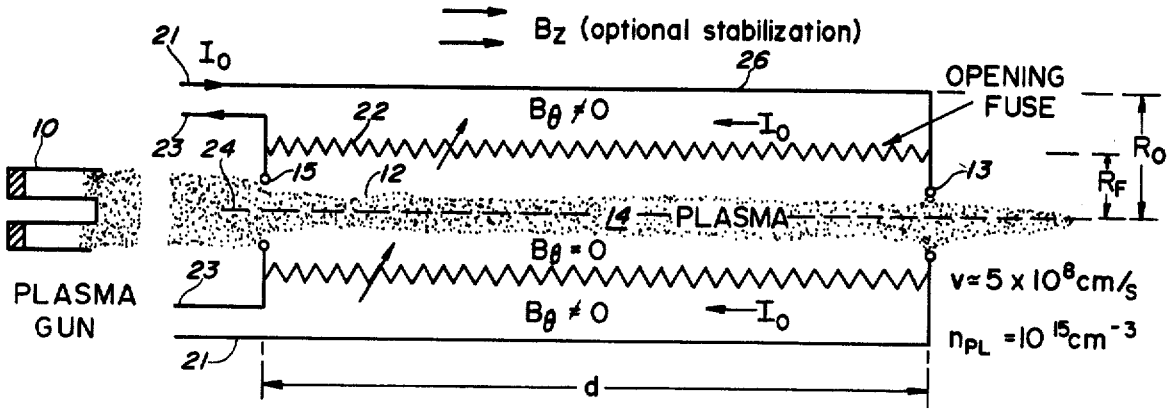
ACCELERATION PHASE: FIG. 2b
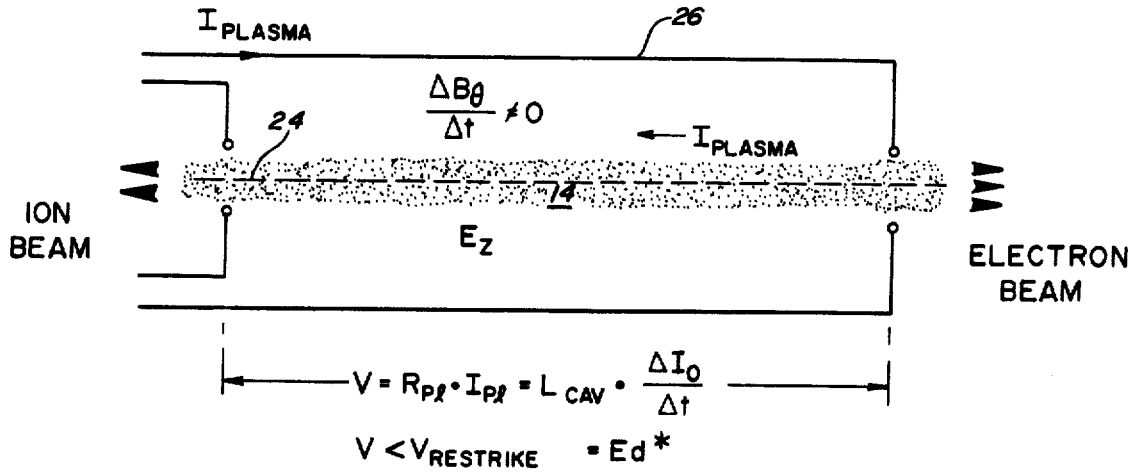
FIG. 3
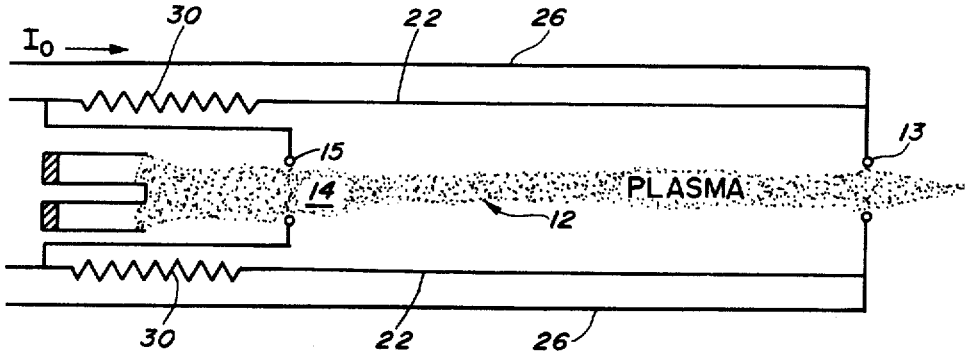

INDUCTIVE INTENSE BEAM SOURCE

BACKGROUND OF THE INVENTION

The present invention relates generally to particle pulse generation, and more particularly to the generation of intense particle beams via the coupling of large amounts of energy from an inductive store directly to an intense particle beam.

Intense particle beams are used in nuclear weapon effects simulation, target heating for inertial and magnetic confinment fusion, laser pumping, microwave and pulsed x-ray production, as injectors for high current accelorators, and in advanced weapons systems. The conventional techinque for producing intense electron and/or ion beams is to apply a sharp, high voltage pulse of very short duration to a pair of electrodes forming a diode. Typically, a capacitive energy store such as a capacitive pulse forming line will be used to provide the short duration, high voltage pulse to the diode. Systems of this type have been built and operated at upto megajoule energy levels, voltages of several megavolts and currents in excess of a megampere. However, such systems are quite large and expensive, primarily due to the electric field strength limitations on capacitive energy storage.

Magnetic compression of plasma is another method available for accelerating a particle beam. However, magnetic compression systems are inherently inefficient because particle (electron) acceleration is limited to a potential of no more than a few times that of the source voltage due to the inherent nature of the acceleration mechanism. Additionally, the beam extraction time is a small fraction of the period over which the compression occurs.

Additional methods bearing on the generation of particle streams also include those used to induce large currents in plasmas, the so-called, theta and toroidal pinches. The major components of the particle streams generated with these methods have low energies in comparison with the source voltage. In some cases a very small component of the stream attains high (runaway) velocity. In general, though, the theta and toroidal devices act like transformers efficiently coupling via their magnetic fields the stored energy from a capacitive bank external to the device to the plasma. In essence, the magnetic field of the device is used to couple energy from the electric field of the bank to kinetic energy of the particles. The low energies of the particles in these devices are the result of the high plasma density used in such devices. Additionally, the use of the closed plasma path in the toroidal pinch geometry also makes it impossible to extract the particle streams to a region external to the plasma.

A highly desirable alternative to the above set out methods is to use inductive energy storage to supply the energy to generate voltage pulses. Such inductive energy storage systems are limited only by the mechanical strength of the conductors in the system and can exceed the energy storage density of capacitive systems by factors of a thousand or more. Typically, in such systems primary energy sources such as rotating electrical machinery (homopolar generators, or pulse alternators, for example) or magnetodynamic systems (magnetic flux compression generators or pulsed MHD devices) may be utilized to supply current to a storage inductance. The use of such rotating electrical machinery as the primary energy source is especially advantageous in that such machines require significantly less volume that capacitor banks and are thus extremely compact. However, such current sources typically have rise-times on the order of $10^{1}$–$10^{-4}$ seconds which are much longer than the operating times of intense beam diodes ($10^{-6}$–$10^{-7}$ seconds). Since these rise-times are significantly longer than that desired for driving intense beam diodes, the current must be carried by a separate auxiliary element during the time required for delivery of energy to the inductive store. Current flow in this auxiliary element must then be interrupted in order to direct energy into a diode connected in parallel with the auxiliary element to generate the actual intense beam pulse. For further discussion on this point, see the reference *Pulsed High Magnetic Fields,* by Heinz Knoepfel, American Elsevier Publishing Company, 1970 Chapter 6. Various problems arise in attempting to efficiently couple the energy from the inductive store to the diode in a short time in an efficient manner.

OBJECTS OF THE INVENTION

It is an object of the present invention to provide a highly efficient method of transferring energy from an energy store to a plasma column in order to generate an intense particle pulse.

It is a further object of the present invention to utilize inductively stored energy to accelerate a particle beam.

It is still a further object of the present invention to provide an intense beam source which can use an electromechanical energy source so that it will be very compact.

It is a further object of the present invention to provide an intense beam source which is suitable for parallel modularization.

Other objects, advantages, and novel features of the present invention will become apparent from the detailed description of the invention, which follows the summary.

SUMMARY OF THE INVENTION

Briefly, the foregoing and other objects are realized in the present invention by juxtaposing a plurality of current carrying elements around the periphery of a plasma column such that energy is stored in the magnetic field in the volume surrounding these elements when current is flowing therein and is segregated thereby from the plasma column. In the limit, the plurality of elements could be replaced by a cylindrical foil enclosing the plasma column. By then truncating the current in these elements or foil, the energy in this storage volume may be inductively converted directly to kinetic energy in the form of an accelerated intense particle beam.

In one embodiment, the present invention comprises an elongated interaction cavity with effectively apertured electrodes at each end thereof approximately centered around the axis of the cavity, a plasma source for generating and injecting a density-controlled fast-moving plasma into the interaction cavity such that the plasma will form a column between the cavity electrodes, a high energy particle window disposed at one end of the interaction cavity for passing therethrough accelerated particle beams emerging from the aperture of one of the electrodes, a plurality of current interrupting devices, each connected between the effectively apertured electrodes and disposed at intervals around and in parallel with the cavity axis at least a predetermined distance therefrom, and a circuit for applying a current pulse to flow through the plurality of current interrupting devices connected between the electrodes to thereby store energy in the magnetic field in the volume around this plurality of devices. In operation, with the plasma column established between the apertured electrodes, a current is applied through the plurality of current interrupting devices thereby storing energy in the volume therearound. When the devices interrupt the current flowing therein, energy from the storage volume will be coupled inductively to the plasma column thereby generating an intense beam of particles directed through the high energy particle window. It should again be reiterated that in the limit, this plurality of current interruption devices could be replaced by a cylindrical foil.

In a second embodiment of the present invention, the plurality of current interruption devices are replaced by a plurality of current carrying elements, each again disposed around the periphery of and in parallel with the interaction cavity axis, for carrying current and storing energy in the magnetic field in the volume therearound. The embodiment further includes an interruption devices for interrupting the current flowing to the current carrying elements, such that the current interruption in the elements inductively couples energy directly to the plasma column to form an intense beam of particles directed through the high energy particle window.

BRIEF DESCRIPTION OF THE DRAWINGS

FIG. 2*a* is a cross-section view of the plasma interaction channel in combination with the plurality of fuses disposed therearound.

FIG. 2*b* is a cross-section diagram of the plasma interaction cavity during the acceleration phase with the fuses vaporized.

FIG. 3 is a cross-section diagram of the plasma interaction cavity in combination with current carrying elements.

DETAILED DESCRIPTION OF THE PREFERRED EMBODIMENT

Figure 1A:
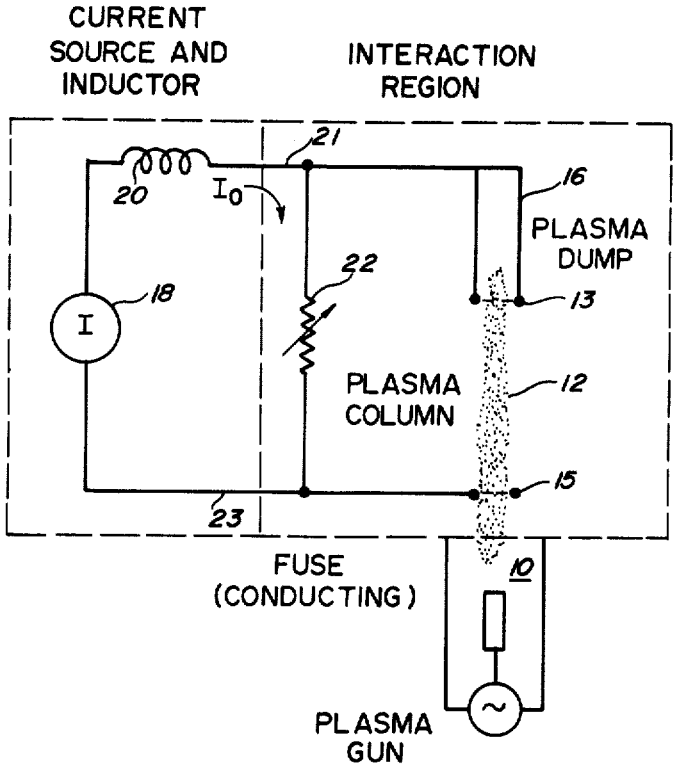
FIG. 1*a* is a circuit diagram of one embodiment of the inductive intense beam source of the present invention with the current interrupting device conducting.

The basic circuit diagram for the inductive intense beam source is shown in FIG. 1*a*. As noted above, the purpose of the present invention is to couple energy efficiently from an energy store to a plasma column to thereby generate an intense particle beam pulse. Accordingly, a plasma gun 10 is provided for generating a column of plasma 12 and injecting it along a plasma interaction cavity 14 to a plasma dump 16. The interaction cavity 14 is bounded by the electrodes 13 and 15. For convenience, these electrodes may be apertured in the center or apertured with a screen there across.

A current source 18 is included for providing current through an inductive store 20 to the plasma column 12. The current source may be implemented by a rotating electrical machine (homopolar generator, or a pulse alternator) or magnetodynamic systems (magnetic flux compression generators, or pulsed MHD devices). As noted above, the use of electromechanical current sources is advantageous in that such machines require significantly less volume than capacitor banks and thus are extremely compact. The inductive store 20 could be implemented, by way of example, by an actual inductive element, or simply by a section of transmission line.

Figure 1B:
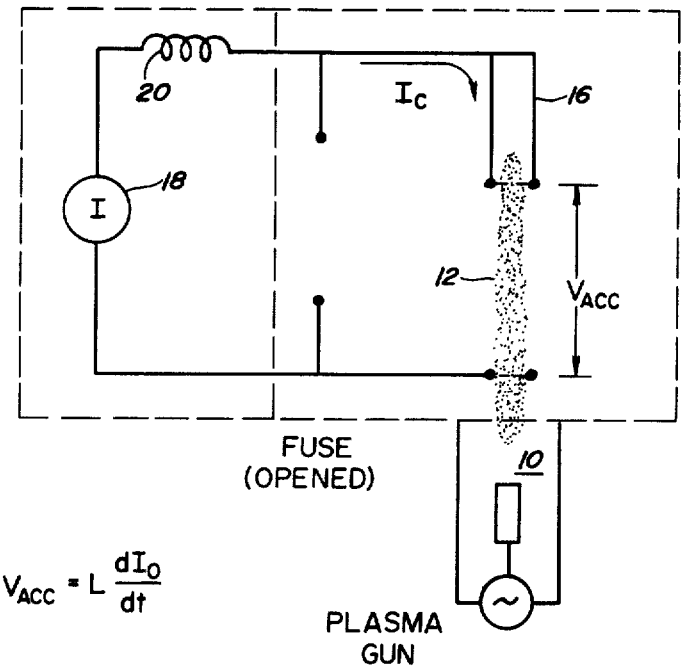
FIG. 1*b* is a circuit diagram of the inductive intense beam source with the current interrupting device open.

Initially, the current from the current source 18 flows in a circuit through the inductive store 20 and through either a current carrying element or a current interrupting device 22 connected electrically in parallel with the electrodes 13 and 15 of the plasma channel 12. When the current through the inductive store 20 has reached its maximum, then the current in the element 22 will be interrupted thereby causing the generation of a large accelerating voltage pulse across the electrodes 13 and 15 of the interaction cavity 14. This accelerating voltage $V_{acc}=L(dI_o/dt)$ will operate to accelerate the particles in the plasma column 12 in order to oppose the change in current. The direction of particle acceleration will depend on the charge of the particle. The circuit configuration when the current $I_o$ flowing through the element 22 is interrupted is shown in FIG. 1*b*.

The plasma interaction cavity 14 and the current interruption devices or current carrying elements 22 are shown in more detail in FIG. 2*a*. The plasma gun 10, which, by way of example, may be implemented with a plasma deflagration gun, generates a column of fast moving (20–100 cm/$\mu$ sec) well collimated plasma which is injected along the axis 24 of the plasma interaction cavity 14. Typically, the column will have a diameter ranging from 0.5 to 3 cm, with a length ranging from 20–40 cm. By way of example, and not by way of limitation, a typical deflagration plasma gun that may be utilized to implement the present invention is disclosed in the article "Plasma Deflagration and the Properties of a Coaxial Plasma Deflagration Gun" by Dah Yu Cheng, *Nuclear Fusion* 10, 305 (1970). The particular type of gas utilized in the deflagration gun will depend on the application for the plasma. If a fast moving plasma is desired, then a light gas such as hydrogen or helium may be utilized. If a heavy gas is required, then a gas such as xenon may be utilized.

For convenience, the plasma interaction cavity 14 may be bounded by a current-carrying cylinder of radius $R_0$ connected to the current source 18. The current carrying cylinder 26 may, in some embodiments, be used to form the vacuum chamber for the plasma column 12. The current $I_o$ from the current source will flow in a sheet in the current carrying cylinder.

As noted above, the present invention is based on the juxtaposition of a plurality of the current interrupting devices or current carrying elements 22 around the periphery of the plasma column 12 such that energy is stored in the magnetic field in the outer volume surrounding these elements when a current flows therein. Such a juxtaposition of these elements will permit the energy stored in the magnetic field in this storage volume to be inductively converted directly to kinetic energy in the form of an accelerated intense particle beam when the current flowing through these elements is then truncated. Accordingly, in the embodiment shown in FIG. 2*a* a plurality of current interrupting devices 22 are each connected electrically across the effectively apertured electrodes 13 and 15 and are disposed at intervals around and in parallel with the axis 24 of the interaction cavity 14. These current interruption devices should be disposed a distance $R_F$ from the axis which will be determined by testing in the particulr application. Factors to be taken into account in setting this distance are the desire to avoid interference between the vapor from the fuse vaporization and the plasma and the desire to prevent hot spots in the fuse (occurring with a non-uniform vaporization) from preventing the remainder of the fuse from vaporizing due to breakdown through the plasma. In a preferred embodiment, this plurality of current interruption devices 22 are equally spaced around the axis 24 of the interaction cavity and are all disposed a distance $R_F$ therefrom. In some applications a dielectric wall can be placed between the plasma column and fuses. This dielectric wall may be used to form the vacuum chamber for the plasma column 12.

The current interrupting devices 22 referred to above, may be implemented, by way of example, by fuses designed to vaporize in accordance with either a time or a current parameter. The choise of fuse cross-section will of course determine the vaporization time and may be chosen to occurr at the same time as the realization of the peak current in the circuit in order to obtain the most efficient operation. The number of fuses 22 utilized and their arrangement around the axis 24 may be modified in accordance with the particular application. For example, the number of fuses could be increased in order to increase the packing density around the plasma column so as to optimize the induced voltage per unit length of the plasma column. Typically, the number of fuses utilized will range from 100–300, or in the limit could be replaced by a continuous cylindrical foil.

The complete circuit for the current flow with the fuses 22 in place is from the current source 18, through the inductive store 20, through the line 21, the current carrying cylinder 26, the electrode 13, the fuse 22, the electrode 15, the line 23, and back to the current source 18. In operation, the current source will provide a pulse of current with a peak value $I_o$ through the plurality of fuses 22. The azimuthal magnetic field set up by the flow of current through the plurality of fuses 22 will store energy therein. This azimuthal magnetic field generated by the fuse current will be confined effectively to the region $R_o - R_f$ (the volume bounded by the current carrying cylinder 26 and the plurality of fuses 22), thereby eliminating any interaction between the magnetic field and the plasma column 12 in the center of the interaction cavity 14. As the current flows through the fuse 22, heat will be generated therein causing the fuse resistance to rise. At a given point in time, depending on the cross-section of the fuses, the current flow will vaporize the fuses, thereby breaking the circuit and causing the fuse resistance to rise to a very high value. This high resistance value of the fuses causes the current in the circuit to interrupt and develope a voltage across the electrodes 13 and 15, i.e. across the plasma column 12. This voltage is given by the cavity inductance L, nH, (which, for a cavity length d in cm, is approximately 2d ln $(R_o/R_f)$) and the rate of current change $(dI_o/dt)$, as $V=L(dI/dt)$. This developed voltage is a sharp pulse which opposes the decrease in the current through the fuses 22 and is proportional both to the energy stored in the magnetic storage volume around the fuses and to the time rate of change of the current. This sharp voltage pulse causes the current from the plurality of fuses 22 to continue its flow in the plasma column 12 and acts to accelerate the charged particles in the plasma column 12 along the direction of the voltage potential set up across the electrodes 13 and 15 to try to maintain the previous current flow through the fuses. FIG. 2b shows the interaction cavity 14 with the fuses vaporized.

An alternative way of viewing the resulting physical effects from the fuse 22 vaporization is that the magnetic field B confined to the region bounded by the plurality of fuses 22 and the current carrying cylinder 26 is suddenly released to implode onto the plasma column 12. This change of the magnetic field, $B_o$, at the plasma boundary and its penetration into the plasma column 12 induces an electric field $E_z = \int (dB/dt)\, dr$, along the axis 24. For a given $E_z$, which will depend on the rate of current decay of the fuses 22, the amplitude of the current commutated to the plasma column, $I_{pl}$, will depend on the fuse-plasma inductance.

The particle drift velocities required by the plasma current, $I_{pl}$, with a cross-section A, depends on the density of the unit charges e $$I_{pl} = -nev_e + n_i Z_i e v_i$$

where n and $n_i$ are electron and ion densities respectively, and $Z_i$ is the ion charge. For a neutral plasma, $n_e = n_i Z_e = n$. If sufficiently low values of n are used, the response of the plasma to commutation of the current is to increase significantly the particle velocities $v_i$ and $v_e$ (and the particle energies, $U_i$ and $U_e$) until the equation for the plasma current $I_{pl}$ is satisfied. Using this configuration, electron pulses with relativistic energies may be generated with relatively low accelerating potentials (50–100 Kev). Such types of acceleration have been observed in theta-pinch and Z-pinch experiments and, generally, lead to increased plasma resistance, which regulates the plasma current limits.

Since the induced electric field is in the direction of the plasma axis 24, the particle drift velocity is also in that direction, resulting in the ejection of both positive and negative charged particle beams at the ends thereof. (The plasma gun may, of course, be arranged so that it is not damaged.) As the current increases to its peak value in the plasma column 12, additional interactions between the streaming and the non-streaming parts of the plasma become less significant. (This is due to the fact that as the current increases, the particles are accelerated to higher velocities and have much smaller collision cross-sections, thus making the collision of the accelerated particles with their background much less probable.)

Axial magnetic fields $B_z$ may be superimposed around the plasma interaction cavity for radial confinement of the plasma column and for better control of the axial uniformity of the plasma resistance as shown in FIG. 2a.

Maximum particle energies in the ejected beams at the ends of the plasma interaction cavity 14 will correspond to the inductive voltage $V_{acc} = L(dI_{pl}/dt)$. Small ion $(dI_{pl}/dt)$ currents of high energy particles are possible as a result of collective electron-ion interactions. However, the maximum ejected beam currents will not exceed the commuted current, $I_c$. This current may be written in terms of the cavity and plasma load inductance (for cavities with a transient time shorter than the current transfer time): $V = R_{pl} I_{pl} = -L_{cav}(dI_{pl}/dt)$. Accordingly, it can be seen that the current buildup in the plasma column will be determined by the inductances in the fuse and the plasma.

In essence, a direct conversion of magnetic energy from an inductive storage volume to kinetic energy in the form of an accelerated particle beam pulse has been obtained by juxtaposing a plurality of current interrupting devices 22 around the periphery and coaxial with the plasma interaction cavity 14. From the above, it is clear that the elements 22 disposed around the periphery of the plasma interaction channel are not restricted to current interrupting devices such as fuses. For example, the elements 22 could be implemented by a plurality of current carrying elements such as, by way of example, simple wires disposed coaxially around the periphery of the plasma channel. An embodiment utilizing such current carrying elements around the plasma interaction channel is shown in FIG. 3. These current carrying elements 22 are connected across the electrodes 13 and 15 in the same manner as the current interrupting devices shown in FIG. *2a*. Thus, current will flow from the current source 18 (FIG. *1a*) through the current carrying cylinder 26, through this plurality of current carrying elements 22 and back to the current source 18. The current flow through these current carrying elements 22 will generate a magnetic field therearound which will operate to store magnetic energy therein. This magnetic field will again be confined in the volume between the plurality of current carrying elements 22 and the current carrying cylinder 26. As in the embodiment shown in FIG. *2a*, the current flowing through these current carrying elements 22 will have to be interrupted in order to transfer the energy from the magnetic storage volume to the plasma column 12. Accordingly, a current interrupting device 30 must be disposed in the circuit feeding the current carrying elements 22. This current interrupting device 30 may be implemented, by way of example, simply by a fuse which may be located either outside of or within the vacuum chamber formed by the current carrying cylinder 26. In essence, the magnetic field will collapse around the fuse 30 and couple to the plasma therethrough. It should be noted, of course, that with the embodiment of FIG. 3, the external fuse 30 would inherently store some energy in its inductive field. Thus, there would be a detrimental energy redistribution to the inductive field of this fuse. Accordingly, the efficiency of this embodiment would be lower than the embodiment disclosed in FIG. *2a*.

The above disclosed apparatus and method for generating intense streams of high energy particles has a number of significant advantages over the prior art. Specifically, the use of inductive energy storage and the juxtaposition of this energy storage volume relative to the particle source (plasma column) yields an extremely efficient energy transfer from the energy store to the plasma and also results in a very compact overall system. The use of inductive storage also eliminates the need for pre-charging the system to high voltages. The design of the system allows the magnetic field initially storing the energy to be arranged immediately around the plasma column without interacting with it until required to do so. This arrangement makes it possible to transfer the energy to the plasma column in a very short time, preventing undesirable disruptions of the plasma, i.e. hydrodynamic instabilities, etc. Finally, because the current interrupting devices or opening switches (fuses) associated with the inductive system operate well in terms of synchronization in parallel configuration (in contrast to the closing switches associated with the capacitive storage of energy), this method for the generation of ion and electron beams is suitable for parallel modularization to achieve a wide range of particle beam currents. For example, a plurality such as ten plasma sources could be driven by a single current source to generate ten or more parallel plasma beams. The vaporization of the fuses around these various plasma sources would then be synchronized. In another embodiment, it would be possible to connect a plurality such as ten homopolar generators to a common point and then to divide the current from this common point to ten different modules. Such a configuration would again insure the synchronization of the fuse vaporization. The foregoing is in contrast to the difficulties arising in attempting to synchronize a plurality of closing switches in a capacitive system.

It should be noted that there are a variety of current interrupting devices available to those skilled in the art to implement the present invention. For example, instead of the fuse elements disclosed above, a plurality of electron beam-controlled opening switches could be utilized in place thereof. These opening switches have the characteristic of faster opening times and higher induced electric fields.

It should also be noted that an essential feature to the production of particle beams in the present invention is the use of the rapid commutation of current to a plasma with its density adjusted to force the particle drift energy up to an accelerating potential. Additionally, the juxtaposition of the current interrupting devices around the periphery of the plasma interaction cavity in order to perform the double function of segregating the magnetic energy from the plasma channel until the accelerating potential is developed and then interrupting the inductive storage current to generate an accelerating field to thereby transfer energy from the magnetic field to the charged particles is unique.

Finally, it should be noted that because the plasma characteristics are established by an external source such as a deflagration gun and the switching is performed separately, the arrangement described above provides for an easy scaleup. This characteristic is in contrast to other methods used for the extraction of energetic particle beams from plasma sources. Use of an external plasma source also allows the use of different ion species for acceleration.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. An inductive intense beam source for generating intense particle beams comprising:

an elongated interaction cavity with effectively apertured electrodes at each end thereof approximately centered on the axis of said cavity;

a plasma source for generating and injecting a density-controlled fast-moving plasma into said interaction cavity such that the plasma will form a column between said cavity electrodes;

a high energy particle window disposed at one end of said elongated interaction cavity for passing therethrough accelerated particle beams emerging from the aperture of one of said electrodes;

a plurality of current interrupting devices each connected electrically across said apertured electrodes and disposed at intervals around and in parallel with the axis of said interaction cavity at some distance from said axis; and circuit means for applying a current pulse to flow through said plurality of current interrupting devices such that energy is stored in the magnetic field in the volume around said plurality of devices and is segregated thereby from said plasma column;

wherein, with said plasma column established between said apertured electrodes, said plurality of current interruption devices will conduct the current pulse thereby storing energy in the volume therearound and then, after a period of time, will interrupt the current resulting in the generation of an intense beam of particles directed through said high energy particle window.

2. An inductive intense beam source as defined in claim 1, wherein said current interruption devices are fuses.

3. An inductive intense beam source as defined in claim 1, wherein said plurality of current interruption devices comprise, in the limit, a cylindrical interruption foil enclosing said interaction cavity.

4. An inductive intense beam source as defined in claim 2, wherein said elongated interaction cavity is housed in a current carrying cylinder and said plurality of current interruption devices are disposed in parallel to said cavity axis inside of said vacuum chamber.

5. An inductive intense beam source for generating intense particle beams comprising:

an elongated interaction cavity with effectively apertured electrodes at each end thereof approximately centered on the axis of said elongated cavity;

a plasma source for generating and injecting a density-controlled fast-moving plasma into said interaction cavity such that the plasma will form a column between said cavity electrodes;

a high energy particle window disposed at one end of said elongated interaction cavity for passing therethrough accelerated particle beams emerging from the aperture of one of said electrodes;

a plurality of current conducting elements, each connected electrically across said effectively apertured electrodes and disposed at intervals around and in parallel with the axis of said interaction cavity at some distance from said axis;

circuit means for applying a current pulse to flow through said plurality of current carrying devices connected between said electrodes such that energy is stored in the magnetic field in the volume around said plurality of elements;

interruption means connected to said circuit means for interrupting the current flowing therein to said plurality of current carrying elements such that, if a plasma column is established between said effectively apertured electrodes, then the current interruption in said elements will couple energy to said plasma to form an intense beam of particles direct through said high energy particle window.

6. An inductive intense beam source as defined in claim 5, wherein said interruption means is a fuse connected in series in the circuit of said circuit means.

7. An inductive intense beam source as defined in claim 5, wherein said plurality of current carrying elements comprise, in the limit, a cylindrical foil enclosing said interaction cavity.

8. An inductive intense beam source as defined in claim 6, wherein said elongated interaction cavity is housed in a current carrying cylinder and said plurality of current carrying elements are disposed in parallel to said cavity axis inside of said cylinder.

9. An inductive intense beam source as defined in claims 3, 4, 7, or 8, wherein said pulse applying circuit means comprises:

an inductive energy store; and current source means connected in electrical series with said apertured electrodes of said elongated interaction cavity.

10. An inductive intense beam source as defined in claim 9, wherein said current source means is an electromechanical energy source.

11. An inductive intense beam source as defined in claim 9, werein said current source means is a magnetodynamic system.

12. An inductive intense beam source as defined in claim 9, wherein said plasma source is a plasma deflagration gun.

13. An inductive intense beam source as defined in claim 4, wherein said plurality of fuses are equally spaced around the axis of said interaction cavity and are all disposed a predetermined distance therefrom.

14. An inductive intense beam source as defined in claim 10, wherein said plurality of current carrying elements are equally spaced around the axis of said interaction cavity and are all disposed a predetermined distance therefrom.

15. An inductive intense beam source as defined in claim 9, wherein said plasma source generates a low density plasma column such that its particle drift energy will be forced to increase significantly with a current interruption.

16. A method for generating an intense particle beam comprising the steps of:

generating a low density plasma column;

running a current through a plurality of current carrying elements disposed around the outer periphery of said plasma column to thereby store energy in the magnetic field in the volume around the plurality of current carrying elements; and truncating the current flow in said plurality of current carrying elements resulting in the generation of an intense beam of particles.

17. A method as defined in claim 16, wherein said current carrying elements are fuses and said truncating step comprises the step of vaporizing the fuses with the current flow.

* * * * *